United States Patent [19]

Allaire et al.

[11] Patent Number: 4,479,921

[45] Date of Patent: Oct. 30, 1984

[54] SOLID FUEL HEATING APPLIANCE AND COMBUSTOR APPARATUS THEREFOR

[75] Inventors: Roger A. Allaire, Big Flats; Louis S. Socha, Jr., Painted Post; Robert V. Van Dewoestine, Corning, all of N.Y.

[73] Assignee: Corning Glass Works, Corning, N.Y.

[21] Appl. No.: 368,844

[22] Filed: Apr. 15, 1982

[51] Int. Cl.[3] ..... F01N 3/10

[52] U.S. Cl. ..... 422/180; 110/211; 110/214; 126/77; 431/171; 431/268

[58] Field of Search ..... 422/115, 177, 180, 200; 110/203, 210, 211, 214, 119; 126/77, 80; 431/171, 268; 423/210 S

[56] References Cited

U.S. PATENT DOCUMENTS

| | | | |
|---|---|---|---|
| 2,594,914 | 4/1952 | Grosskloss | 431/171 X |
| 3,065,595 | 11/1962 | Gary | 422/177 X |
| 3,207,201 | 9/1965 | Zink et al. | 431/171 |
| 3,380,410 | 4/1968 | Venable, Jr. | 431/171 |
| 3,785,778 | 1/1974 | Burstein et al. | 422/180 X |
| 3,881,316 | 5/1975 | Bunda et al. | 422/177 X |
| 3,910,770 | 10/1975 | Kobylinksi et al. | 422/180 X |
| 4,054,418 | 10/1977 | Miller et al. | 110/203 X |
| 4,319,556 | 3/1982 | Schwartz et al. | 110/203 X |
| 4,330,503 | 5/1982 | Allaire et al. | 110/214 X |
| 4,373,507 | 2/1983 | Schwartz et al. | 422/177 X |

*Primary Examiner*—Richard L. Chiesa
*Attorney, Agent, or Firm*—R. N. Wardell

[57] ABSTRACT

A solid fuel heating appliance in the form of a wood burning stove employs a combustor for oxidizing oxidizable species in the exhaust. A flame break is provided between the combustor and the combustion chamber of the stove to avoid impingement of flames on the combustor.

15 Claims, 12 Drawing Figures

SOLID FUEL HEATING APPLIANCE AND COMBUSTOR APPARATUS THEREFOR

BACKGROUND OF THE INVENTION

This invention relates to solid fuel heating appliances, and more particularly to appliances which burn wood, densified or compacted wood products, coal, charcoal, peat, compacted trash or similar solid fuels and utilize a combustor to promote oxidation of oxidizable species in the exhaust of such appliances.

U.S. patent application Ser. No. 173,155 filed July 28, 1980 (assigned to the assignee of this application) now abandoned, discloses the use of a combustor in a solid fuel heating appliance. The solid fuel heating appliance in the form of a wood burning stove uses a catalytic converter as a combustor which serves to provide more complete burning or oxidation of the volatile and particulate organic substances present in gases rising from burning wood in a wood burning stove and especially those solid particles and resinous and oily droplets that cause the dense smoke which upon deposition on the inside surface of the flue pipe or chimney are generally known as creosote. More particularly, a catalytic converter which comprises noble-metal catalysts on a suitable substrate reduces the ignition temperatures of carbon monoxide and the lower boiling, more volatile hydrocarbons present in the exhaust issuing from the combustion of wood. As the hydrocarbons and carbon monoxide burn, the temperature of the catalyst and its substrate is raised which increases its catalytic activity. The elevated temperature pyrolyzes and cracks the higher molecular weight hydrocarbons occurring in the smoke as solid particles and oily droplets, converting them to volatile compounds which readily mix with oxygen present and thereby leading to their rapid oxidation. Temperature continues to rise until the system reaches a temperature at which there is equilibrium between the inlet gas temperature, flow rate and the amount of oxidizable material. This temperature is typically 600° C. to 900° C. for a properly sized catalyst system. At these temperatures, oxidation proceeds very rapidly to completion if the catalytic converter has the appropriate volume and internal surface area. As converter temperatures increase, the exhaust gas temperature rises above the ignition point of an increasing number of its constituents so that the catalytic combustion process is augmented by thermal combustion. This high temperature also breaks the complex hydrocarbons and other combustibles (including solid particulates entrained in the combustion gases) into compounds which will burn more easily.

In order to optimize the performance of the combustor or catalytic converter, the combustor should be positioned within or very near the fire box of the wood burning stove. This proximity assures more consistant light off in burning by precluding any substantial cooling of the exhaust gases prior to entry into the combustor. However, positioning of a combustor within or very near the fire box results in the direct impingement on the combustor by flames within the fire box. This flame contact with the combustor can result in severe thermal shock of the combustor, and it has been found that this shock does result in the degradation of the catalytic converter. More specifically, the catalytic wash coat applied to the combustor will flake under the conditions of direct flame impingement. This in turn can result in the blockage of cells within the combustor and the loss of catalysis which can produce a shorter combustor life and a reduced combustor performance.

SUMMARY OF THE INVENTION

It is an overall object of this invention to optimize the performance of a combustor in a solid fuel heating appliance.

It is a more specific general and overall object of this invention to permit the location of a combustor in a solid fuel heating appliance within or very near the fire box of the appliance.

It is a further object of this invention to prevent the direct impingement of flames on a combustor in a solid fuel heating appliance.

It is a further specific object of this invention to avoid severe thermal shock of a combustor in a solid fuel heating appliance.

It is still a further specific object of this invention to optimize the life of a combustor in a solid fuel heating appliance.

It is also a specific object of this invention to improve combustor performance in a solid fuel heating appliance.

In accordance with these and other objects, a preferred embodiment of the invention comprises a solid fuel heating appliance of the type including a combustion chamber, a flue for removing exhaust from the chamber, and a combustor located in the exhaust path between the chamber and the flue. The combustor includes a plurality of cells extending therethrough for oxidizing oxidizable species in the exhaust.

In accordance with this invention, flame breaking means are located between the chamber and the combustor. The flame breaking means includes a solid portion interrupted by one or more openings to allow exhaust to pass therethrough while minimizing the impingement of flames within the chamber on the combustor.

In the preferred embodiment of the invention, the area of the flame breaking means transverse to the flow of exhaust is substantially equal to or larger than the area of the combustor transverse to the flow of exhaust.

The flame breaking means of the preferred embodiment of the invention has a thickness in the direction of exhaust flow through the openings substantially less than the thickness of the combustor in the direction of exhaust flow through the cells. In this connection, it is preferred that the average length of the openings in the direction of exhaust flow therethrough is less than the average length of cells in the direction of the exhaust flow therethrough.

In accordance with one important aspect of the invention, the openings in the flame breaking means are of a size and density and the cells in the combustor are of a size and density so as to produce a pressure drop across the flame breaking means substantially less than the pressure drop across the combustor.

In accordance with another important aspect of the invention, the ratio of the minimum distance of each of the inlets to the openings from the combustor divided by the minimum cross-sectional dimension of each of the openings is greater than 2 and less than 30.

In accordance with another important aspect of the invention, the closed area of the flame breaking means surrounding the openings represents at least 15% of the overall area of the flame breaking means.

In accordance with still another important aspect of the invention, the thickness of the flame breaking means in the direction of exhaust flow is at least 0.5 mm.

In one embodiment of the invention, the flame breaking means as well as the combustor comprise honeycomb structures. The honeycomb structure of the combustor includes a catalyst for promoting oxidation of the oxidizable species.

In another embodiment of the invention, a secondary air inlet is coupled to the flame breaking means for introducing secondary air into the openings of the flame breaking means. The inlet may comprise a tubular member coupled to the flame breaking means which serves as a manifold coupled to the openings which are formed by tubular walls having holes therein forming an outlet for the manifold.

DETAILED DESCRIPTION OF THE PREFERRED EMBODIMENT

Figure 1:
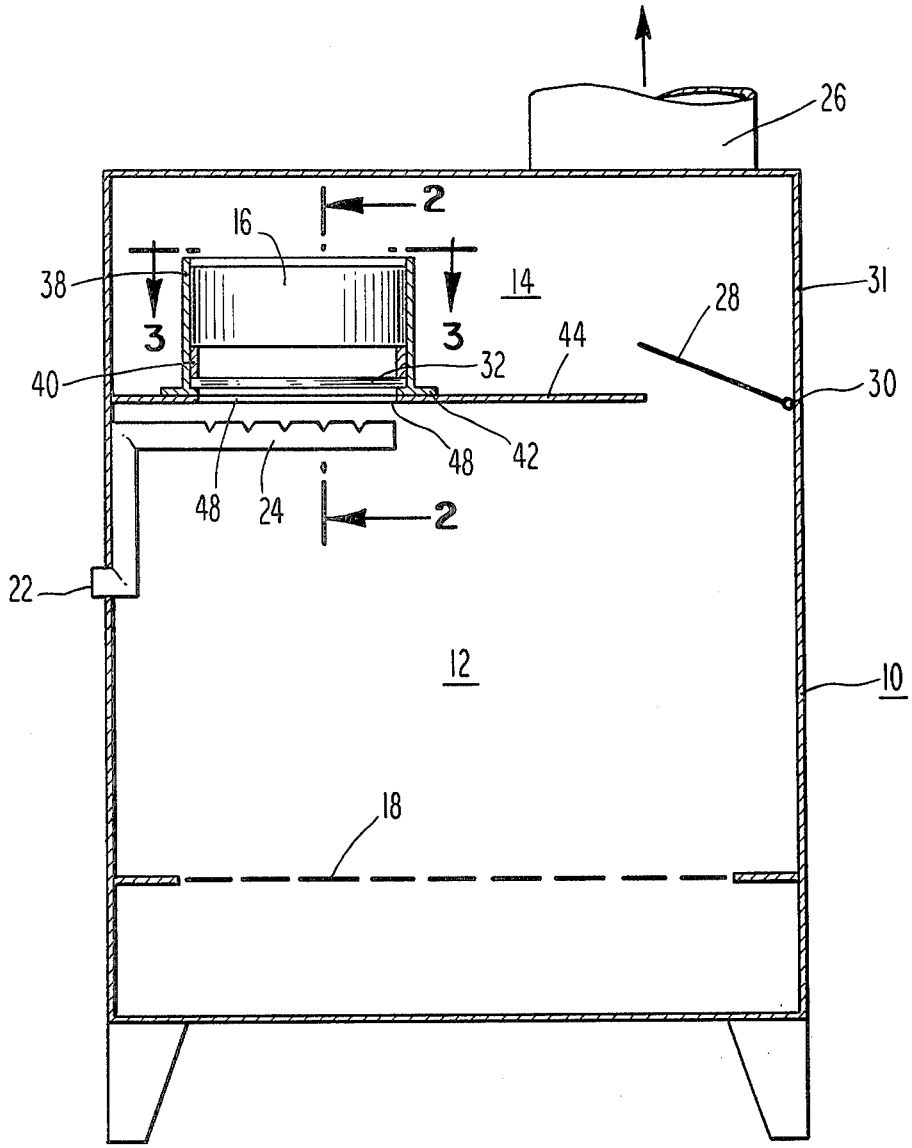
FIG. 1 is a sectional view of a solid fuel heating appliance comprising a wood burning stove representing a preferred embodiment of the invention.

Referring to FIG. 1, a solid fuel heating appliance comprising a wood burning stove 10 is shown including a primary wood combustion chamber or fire box 12 in the lower portion of the stove 10 and an exhaust or secondary combustion chamber 14 in the upper portion of the stove 10. A combustor in the form of a catalytic converter 16 is located between the primary combustion chamber 12 and the exhaust or secondary combustion chamber 14 to promote more complete burning or oxidation of the carbon monoxide, hydrocarbons and other combustibles (including solid particles entrained in combustion gases) exiting from the combustion chamber 12.

The stove 10 includes a grate 18 within the primary combustion chamber 12 for supporting the wood to be burned therein. Air to the primary combustion chamber 12 is supplied through a primary combustion air inlet not shown preferably located near the grate 18 as well as a secondary air combustion air inlet 22 which is coupled to a manifold 24 which provides air or oxygen to the inlet face of the catalytic converter 16 so as to optimize the oxidation or burning within the catalytic converter. The manifold 24 is positioned and designed in the appliance so as to provide adequate premixing of the secondary air from the manifold 24 with combustion gases and fumes before they enter the converter 16. Additional combustion or oxidation and/or heat exchange to living space occurs within the chamber 14 before the exhaust gases leave through a flue 26. It will therefore be appreciated that exhaust flows from the chamber 12, through the converter 16, into the chamber 14 and out through the flue 26.

An adjustable closeable bypass to the flue 26 is preferably provided by a damper 28 which is attached to a pivot or hinged position 30 at a wall 31 of the stove 10 (similar to copending application Ser. No. 136,687 filed Apr. 2, 1980 and assigned to the assignee of this application).

Figure 2:
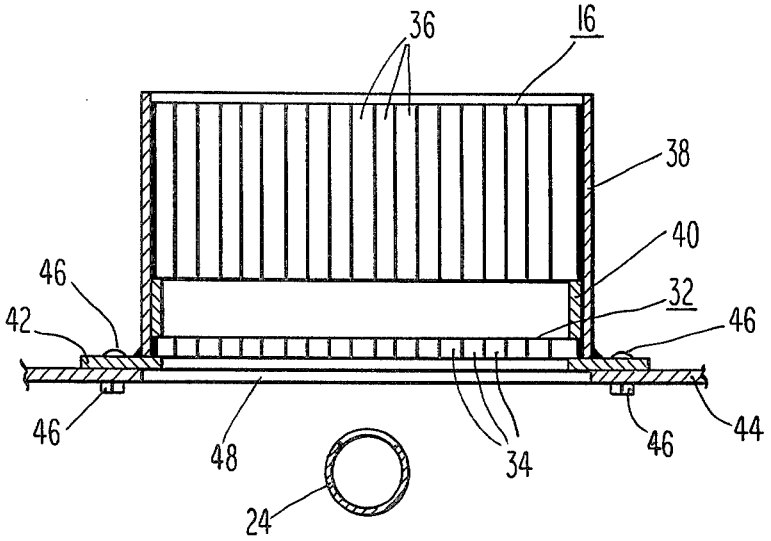
FIG. 2 is an enlarged sectional view of the stove of FIG. 1 taken along line 2—2.
Figure 3:
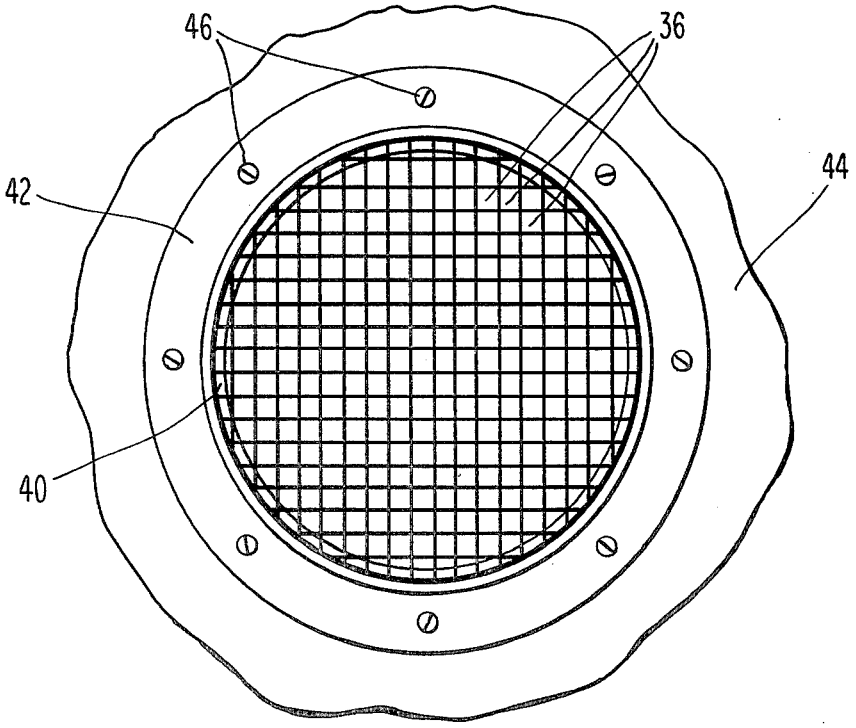
FIG. 3 is a fragmentary plan view taken along line 3—3 of FIG. 1.

In accordance with this invention, the converter 16 is located very close to the chamber or fire box 12. In order to prevent flame from the chamber or fire box 12 from impinging directly on the converter 16, a fire breaking means in the form of a honeycomb structure 32 is provided as may be better appreciated with reference to FIGS. 2 and 3. As shown in FIGS. 2 and 3, the flame breaking means 32 comprises a honeycomb structure having solid walls forming and interrupted by a multiplicity of openings 34 which are substantially equal in size to the cells 36 formed by the walls of the honeycomb structure of the converter 16. It will be appreciated that exhaust from the chamber 12 shown in FIG. 1 passes through the openings 34 of the flame breaking means 32 and on through the cells 36 of the converter 16. The honeycomb structure of means 32 does not contain any catalytic coating thereon nor catalytic substance in the material of such structure.

As shown in FIGS. 2 and 3, the honeycomb structure of the flame breaking means 32 as well the honeycomb structure of the converter 16 are mounted in a tubular member 38 and spaced from one another by a spacing ring 40 which contacts the periphery of flame breaking means 32 and the converter 16 at the interior of the tubular means 38. A flange 42 extends from the tubular means 38 and extends inwardly beneath the honeycomb structure of the flame breaking means 32 so as to support the flame breaking means 32 as well as the converter 16. The flange 42 is secured to a wall 44 separating the primary combustion chamber 12 from the secondary combustion chamber 14 by threaded fasteners 46 adjacent an exhaust path opening 48.

In accordance with one important aspect of the invention, the area of the flame breaking means transverse to the flow of exhaust is substantially equal to or larger than the area of the combustor transverse to the flow of exhaust and juxtaposed to the inlet face of the combustor 16 so as to prevent impingement of flames on the combustor 16. In this connection, it will be appreciated that flames will impinge upon the flame breaking means 32 although no flames are permitted to impinge upon the combustor 16.

In accordance with another important aspect of the invention, the flame breaking means 32 has a thickness in the direction of exhaust through the openings 34 substantially less than the thickness of the combustor 16 in the direction of exhaust through the cells 36 but preferably equal to at least 0.5 mm. In other words, the average length of the openings 34 for the direction of exhaust flow therethrough is less than the average length of the cells 36 in the direction of exhaust flow therethrough. Moreover, the density and the size of the openings 34 compared with the density and size of the cells 36 is important in conjunction with the length to assure that the pressure drop across a flame breaking means 32 is less than the pressure drop across the combustor 16. As shown in FIGS. 2 and 3, the size and density of the openings 34 and the cells 36 are substantially identical. It will be appreciated that other size and density relationships may be provided to assure that the pressure drop across the flame breaking means 32 is substantially less than the pressure drop across the combustor 16. Preferably, the surface area surrounding the openings 34 is at least 15% of the overall area of the flame breaking means 32.

Figure 7:
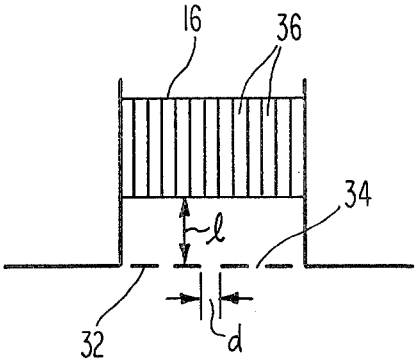
FIG. 7 is a partially schematic, fragmentary sectional view of the embodiment shown in FIGS. 1-3.

In the embodiment of the invention shown in FIGS. 1–3, the flame breaking means 32 is most effective when the ratio of the minimum distance of each of the openings 34 from the combustor divided by the minimum cross-sectional dimension of the openings is greater than 2 and less than 30. As shown in FIG. 7, this requires the ratio of the distance 1 for each of the openings 34 in the flame breaking means 22 divided by the minimum cross-sectional dimension d of the cells to be more than 2 and less than 30.

In the embodiment shown in FIGS. 1 through 3, the flame breaking means 32 comprises a honeycomb structure which, like the combustor 16, may comprise a ceramic material which may be extruded to form this structure shown in detail in FIGS. 2 and 3. Other honeycomb structures made from ceramic material in this and other ways or other materials suitable for use in a honeycomb structure may be utilized. Moreover, a flame breaking means may take on a completely different form as will now be described with reference to the embodiments of FIGS. 4–6.

Figure 4:
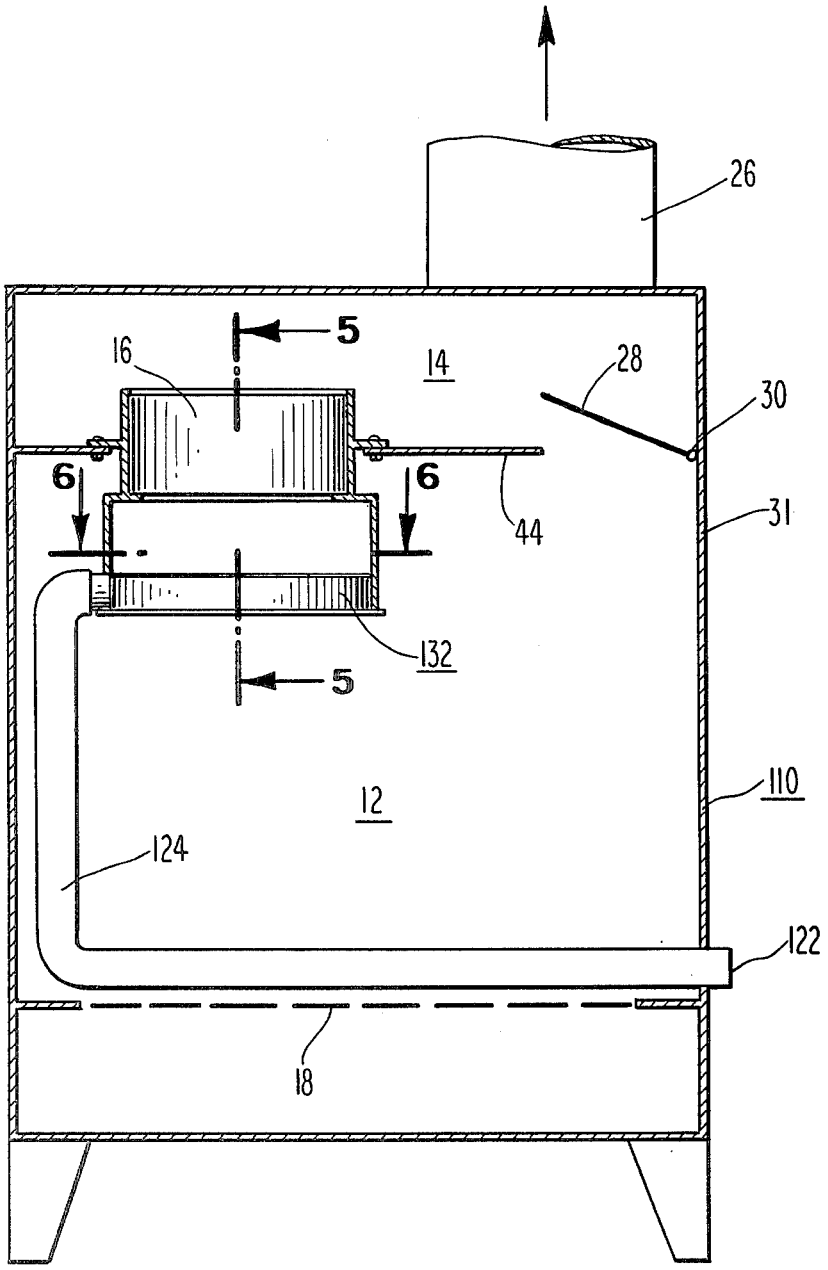
FIG. 4 is a sectional view of a solid fuel heating appliance comprising a wood buring stove representing another preferred embodiment of the invention.

As shown in FIG. 4, a stove 110 comprises a number of elements similar and identically referenced to those of the stove 10 shown in FIG. 1. Where elements of the stove 110 differ from those of the stove 10, a different reference character will be utilized.

Figure 5:
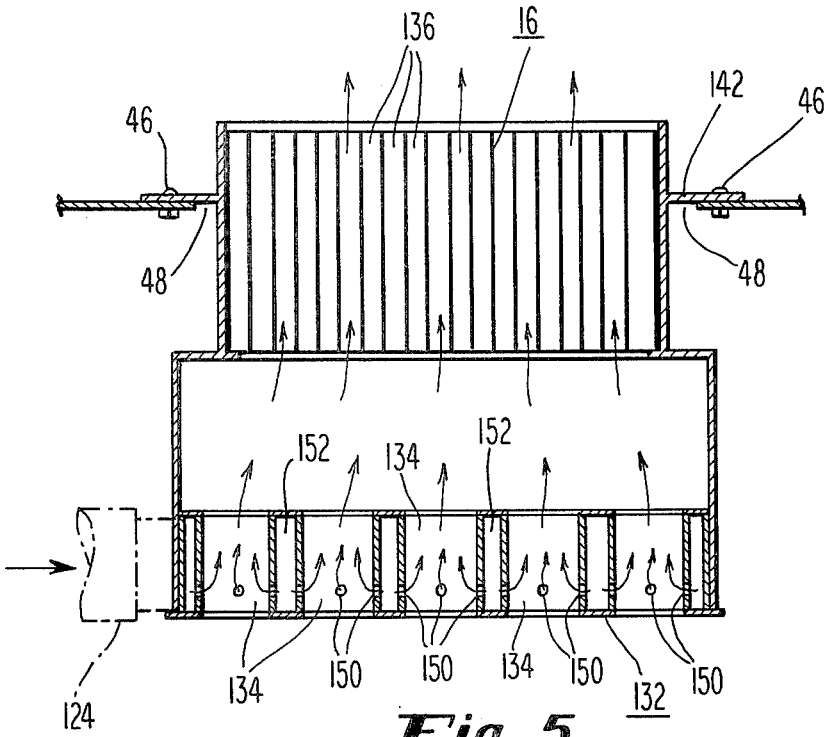
FIG. 5 is a sectional view taken along line 5—5 of FIG. 4.
Figure 6:
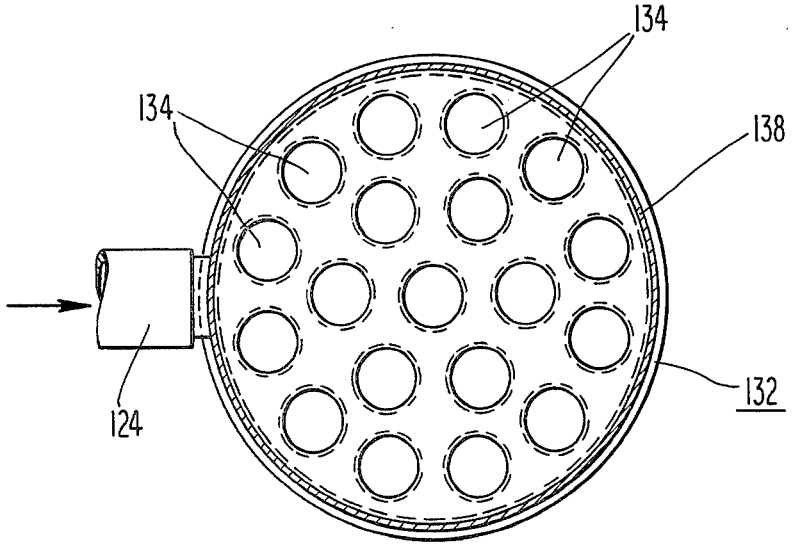
FIG. 6 is a sectional view taken along line 6—6 of FIG. 4.

In the embodiment of FIGS. 4–6, a flame breaking means 132 is coupled to a secondary air source inlet 122 through a pipe 124 which extends generally parallel with the grate 18 across the stove 110 and then upwardly toward the flame breaking means 132.

In accordance with an important aspect of this invention, flame breaking means 132 actually serves as a manifold for distributing the air flowing through the pipe 124 to the plurality of openings 134 shown in FIGS. 5 and 6. In this connection, each of the openings 134 includes holes 150 in the walls of the tubular structures forming the openings 134 so as to permit air to circulate inwardly through the manifold channels 152 as depicted by the arrows so as to supply supplemental or secondary oxygen to the combustor 16.

As shown in FIGS. 5 and 6, the area of the flame breaking means 132 transverse to the flow of exhaust is slightly larger than the area of the combustor 16 transverse to the exhaust so as to assure that flames within the chamber 12 cannot impinge upon the combustor 16. It will also be noted that the flame breaking means 132 comprises a thickness in the direction of exhaust flow through the openings 134 which is substantially less than the thickness of the combustor in the direction of exhaust flow through the cells 136 and substantially greater than 0.5 mm. The length of the openings 134 in a direction of exhaust flow therethrough is less than the average length of the cells 136 in the direction of exhaust flow therethrough.

Figure 11:
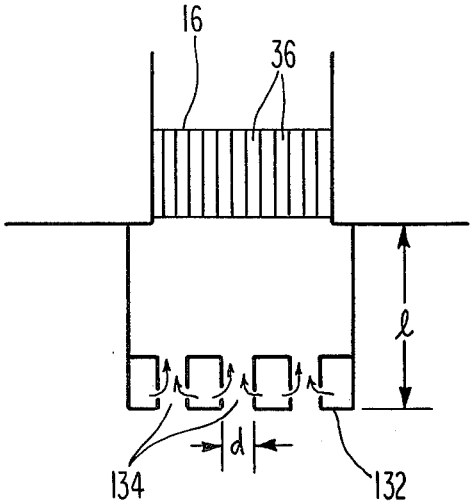
FIG. 11 is a partially schematic, fragmentary sectional view of the embodiment shown in FIGS. 4 and 5.

As also shown in the embodiments of FIGS. 5 and 6, the size of the openings 134 are substantially larger than the size of the cells 136 in the combustor 16, and the density of the cells 134 in the flame breaking means 132 is substantially less than the density of the cells 136 in the combustor 16 so as to minimize the pressure drop across the flame breaking means 132 as compared with that for the combustor 16. It will also be understood with reference to FIG. 11 that the flame breaking function is optimized when the ratio of the distance 1 of the inlet to each opening 34 from the combustor 16 divided by the minimum cross-sectional dimension d of the opening is at least 2 and preferably less than 30. Furthermore, the closed area of the flame breaking means surrounding the openings represents at least 15% of the overall area of the flame breaking means at its inlet face.

Referring to FIG. 5, it will be appreciated that tubular means are again utilized to hold the flame breaking means 132 and the combustor 16 in place. As shown in FIG. 5, the tubular means 138 is necked down at the combustor 16. In the necked down region, a flange 142 extends outwardly toward the wall 44 at the opening 48 with threaded fasteners 46 holding the tubular means 138 in place.

In the embodiment of FIGS. 4 through 6, the tubular means 138 as well as the flame breaking means 132 may comprise steel. Preferably, the combustor 16 comprises a honeycomb structure made from a ceramic material appropriately catalyzed.

Figure 10:
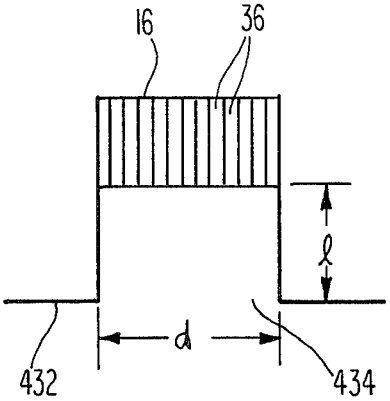
FIG. 10 is a partially schematic, fragmentary sectional view of another embodiment of the invention.
Figure 8:
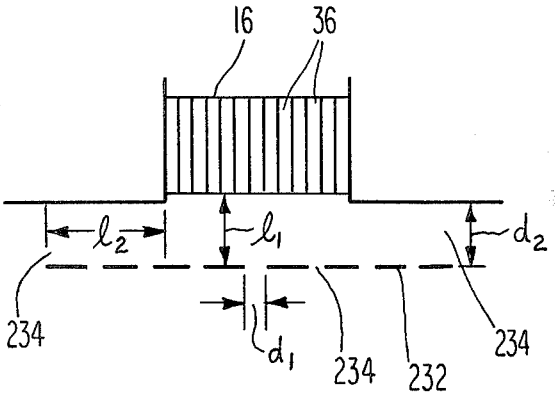
FIG. 8 is a partially schematic, fragmentary sectional view of another embodiment of the invention.
Figure 9:
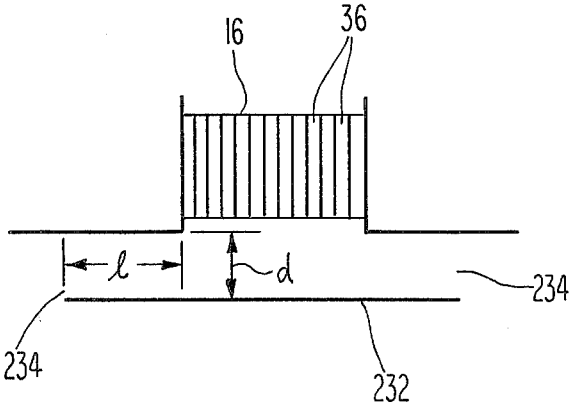
FIG. 9 is a partially schematic, fragmentary sectional view of another embodiment of the invention.

Reference will now be made to FIGS. 8 through 10 which represent embodiments similar to the embodiment of FIGS. 1 through 3, but differing somewhat with respect to the flame breaking means. As shown in FIG. 8, a flame breaking means 232 is provided which is spaced from the combustor 16 with an opening 234 around the periphery of flame breaking means 232 as well as openings 234 in the flame breaking means 232 as depicted in FIGS. 1 through 3 and also shown in FIG. 7. In this embodiment, it will be appreciated that there are a variety of openings 234 in the flame breaking means 232. In this connection, it will be understood that the ratio of the minimum distance of the inlet to each of the openings 234 from the combustor 16 divided by the minimum respective cross-sectional dimension of each of the openings is greater than 2 and less than 30. In other words, the ratio of $l_1$ divided by $d_1$ as well as the ratio of $l_2$ divided by $d_2$ is greater than 2 and less than 30. The flame breaking means 232 may comprise a screen. In a slightly modified embodiment, the screen may be cup shaped to eliminate the opening 234 around the periphery. In the embodiment of FIG. 9, a flame breaking means 332 comprises a solid member such that the only openings or opening to the combustor 16 is the opening 334 at the periphery at the flame breaking means 332. Here again, the important ratio or flame breaking effectiveness is the ratio of l to d. In the embodiment of FIG. 10, the flame breaking means 432 is actually formed by the wall of the combustion chamber. By substantial spacing of the combustor 16 from the wall 432, the desired flame breaking ratio of l to d may be achieved.

Figure 12:
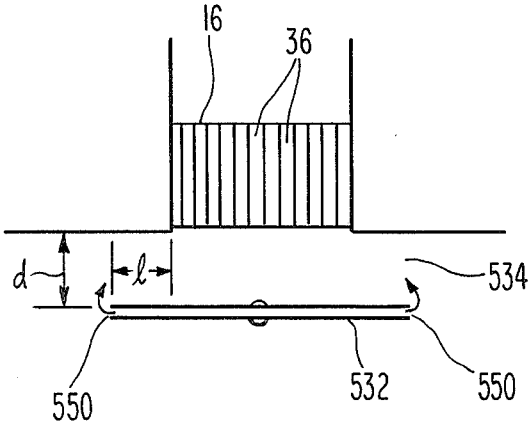
FIG. 12 is a partially schematic, fragmentary sectional view of another embodiment of the invention.

Reference will now be made to FIG. 12 wherein another embodiment is shown which incorporates the flame breaking means with a secondary air source. As shown in there, the flame breaking means 532 comprises a hollow interior with openings 550 coupled to a source of secondary air. Flame breaking means 532 is solid so that the opening 534 is at the periphery of the flame breaking means 532. Here again, the ratio l to d is important to maximize the effectiveness of the flame breaking means.

In the catalytic converter 16, it is, of course, extremely important to assure proper combustion for oxidation of the carbon monoxide, hydrocarbons and other combustibles (including solid particles entrained in the combustion gases) exiting the primary combustion chamber 12. Details concerning the catalytic converter are set forth in the aforesaid co-pending application Ser. No. 173,155, incorporated herein by reference.

Although a wood burning stove has been shown and described in detail, it will be appreciated that the invention may be embodied in other solid fuel heating appliances which can utilize various solid fuels including densified or compacted wood products, coal, charcoal, peat and compacted trash and/or garbage and the like which may give off flames which would impinge upon the combustor 16. Such applicanes may take the form of stoves as well as boilers, incinerators and the like, especially those well-suited for residential use.

Although particular embodiments of the invention have been shown and described, it will be appreciated that various modifications may be made which fall within the true spirit and scope of the invention as set forth in the appended claims.

We claim:

1. In a solid fuel heating appliance of the type comprising:

a combustion chamber;

a flue for removing exhaust from said chamber;

a combustor located in an exhaust path between said chamber and said flue at a position where, in the absence of a flame breaking means, the flame of burning solid fuel in said chamber directly impinges on said combustor, said combustor having a plurality of cells extending therethrough for oxidizing oxidizible species in said exhaust, the improvement comprising:

a flame breaking means located between said chamber and said combustor, said flame breaking means including a solid portion interrupted by a multiplicity of openings to allow exhaust to pass therethrough to light off and maintain oxidation of the oxidizable species in the combustor while minimizing the impringement on said combustor by flames within said chamber and to produce a pressure drop across the flame breaking means substantially less than the pressure drop across the combustor.

2. The appliance of claim 1 wherein the area of said flame breaking means transverse to the flow of exhaust is substantially equal to or larger than the area of said combustor transverse to the flow of exhaust.

3. The appliance of claim 1 wheren said flame breaking means comprises the thickness in the direction of exhaust flow through said openings substantially less than the thickness of said combustor in the direction of exhaust flow through said cells.

4. The appliance of claim 1 wherein the average length of said openings in the direction of exhaust flow therethrough is less than the average length of cells in the direction of exhaust flow therethrough.

5. The appliance of claim 1 wherein the ratio of the minimum distance of the inlet to each of the the openings from the combustor divided by the minimum cross-sectional dimension of each of the openings is greater than 2 and less than 30.

6. The appliance of claim 1 wherein the closed area of the flame breaking means surrounding the openings represents at least 15% of the overall area of the flame breaking means.

7. The appliance of claim 1 wherein the thickness of the flame breaking means in the direction of exhaust flow is at least 0.5 mm.

8. The appliance of claim 1 wherein said flame breaking means comprises a honeycomb structure forming said openings.

9. The appliance of claim 8 wherein said combustor comprises a honeycomb structure forming said cells.

10. The appliance of claim 9 wherein said honeycomb structure of said combustor includes a catalyst for promoting oxidation of said oxidizible species.

11. The appliance of claim 1 further comprising a secondary air inlet coupled to said flame breaking means for introducing secondary air into said opening.

12. The appliance of claim 11 wherein said flame breaking means comprises an air manifold coupled to said openings.

13. The appliance of claim 12 wherein said inlet comprises tubular means coupled to said manifold.

14. The appliance of claim 12 wherein said flame breaking means comprises tubular walls forming said openings, said walls having holes extending therethrough for forming an outlet for said manifold.

15. In a solid fuel heating appliance of the type comprising:

a combustion chamber;

a flue for removing exhaust from said chamber;

a combustor located in an exhaust path between said chamber and said flue at a position where, in the absence of a flame breaking means, the flame of burning solid fuel in said chamber directly impinges on said combustor, said combustor having a plurality of cells extending therethrough for oxidizing oxidizible species in said exhaust, the improvement comprising:

a flame breaking means located between said chamber and said combustor, said flame breaking means including a solid portion with an opening to allow exhaust to pass therethrough to light off and maintain oxidation of the oxidizable species in the combustor while minimizing the impingement on said combustor by flames within said chamber and to produce a pressure drop across the flame breaker means substantially less than the pressure drop across the combustor, the ratio of the minimum distance of said opening from the combustor divided by the minimum cross-sectional dimension of said opening being greater than 2 and less than 30.

* * * * *